US010138598B2

(12) United States Patent
Nonni et al.

(10) Patent No.: US 10,138,598 B2
(45) Date of Patent: Nov. 27, 2018

(54) METHOD OF MAKING A HIGHLY FUNCTIONAL, LOW VISCOSITY KRAFT FIBER USING AN ACIDIC BLEACHING SEQUENCE AND A FIBER MADE BY THE PROCESS

(71) Applicant: GP CELLULOSE GMBH, Zug (CH)

(72) Inventors: Arthur J. Nonni, Peachtree City, GA (US); Charles E. Courchene, Snellville, GA (US)

(73) Assignee: GP Cellulose GmbH, Zug (CH)

( * ) Notice: Subject to any disclaimer, the term of this patent is extended or adjusted under 35 U.S.C. 154(b) by 464 days.

(21) Appl. No.: 14/775,425

(22) PCT Filed: Feb. 24, 2014

(86) PCT No.: PCT/IB2014/000993
§ 371 (c)(1),
(2) Date: Sep. 11, 2015

(87) PCT Pub. No.: WO2014/140852
PCT Pub. Date: Sep. 18, 2014

(65) Prior Publication Data

US 2016/0040362 A1 Feb. 11, 2016

Related U.S. Application Data

(60) Provisional application No. 61/785,075, filed on Mar. 14, 2013.

(51) Int. Cl.

| | |
|---|---|
| ***D21C 9/10*** | (2006.01) |
| ***D21C 9/16*** | (2006.01) |
| ***D21H 21/32*** | (2006.01) |
| ***D21C 9/14*** | (2006.01) |
| ***D21C 3/02*** | (2006.01) |
| ***D21C 9/147*** | (2006.01) |
| ***D21H 11/04*** | (2006.01) |
| ***D21H 11/20*** | (2006.01) |
| ***D21H 17/64*** | (2006.01) |

(52) U.S. Cl.
CPC ..... *D21C 9/163* (2013.01); *D21C 3/02* (2013.01); *D21C 9/1026* (2013.01); *D21C 9/1036* (2013.01); *D21C 9/144* (2013.01); *D21C 9/147* (2013.01); *D21H 11/04* (2013.01); *D21H 11/20* (2013.01); *D21H 17/64* (2013.01); *D21H 21/32* (2013.01)

(58) Field of Classification Search
CPC ..... D21C 9/1026; D21C 9/1036; D21C 9/163
See application file for complete search history.

(56) References Cited

U.S. PATENT DOCUMENTS

| | | | |
|---|---|---|---|
| 1,298,552 | A | 3/1919 | Ornstein |
| 1,298,553 | A | 3/1919 | Ornstein |
| 1,298,554 | A | 3/1919 | Ornstein |
| 1,860,431 | A | 5/1932 | Richter |
| 2,112,116 | A | 3/1938 | Richter |
| 2,178,696 | A | 11/1939 | Muskat et al. |
| 2,212,338 | A | 8/1940 | Bown |
| 2,368,527 | A | 1/1945 | Edelstein |
| 2,512,338 | A | 6/1950 | Klug et al. |
| 2,749,336 | A | 6/1956 | Boddicker et al. |
| 2,975,169 | A | 3/1961 | Cranford et al. |
| 2,978,446 | A | 4/1961 | Battista et al. |
| 3,308,012 | A | 3/1967 | Tobar |
| 3,707,148 | A | 12/1972 | Bryce |
| 3,728,331 | A | 4/1973 | Savage |
| 3,728,213 | A | 7/1973 | Hinz |
| 3,868,955 | A | 3/1975 | Steiger et al. |
| 4,022,965 | A | 5/1977 | Goheen et al. |
| 4,222,819 | A | 9/1980 | Fossum et al. |
| 4,270,976 | A | 6/1981 | Sandstrom et al. |
| 4,410,397 | A | 10/1983 | Kempf |
| 4,427,490 | A | 1/1984 | Eckert |
| 4,444,621 | A | 4/1984 | Lindahl |
| 4,454,005 | A | 6/1984 | Stofko et al. |
| 4,470,212 | A | 9/1984 | Stafford et al. |
| 4,599,138 | A | 7/1986 | Lindahl |
| 4,614,646 | A | 9/1986 | Christiansen |
| 4,619,663 | A | 10/1986 | Tatin |
| 4,661,205 | A | 4/1987 | Ow et al. |
| H479 | H | 6/1988 | Wood et al. |
| 4,756,799 | A | 7/1988 | Bengtsson et al. |
| 4,783,239 | A | 11/1988 | Rich |

(Continued)

FOREIGN PATENT DOCUMENTS

| | | |
|---|---|---|
| CA | 1129161 | 8/1982 |
| CA | 1190360 | 7/1985 |

(Continued)

OTHER PUBLICATIONS

Burgess, "Relationships Between Colour Production in Cellulose and the Chemical Changes Brought About by Bleaching," Transcript of a Lecture given at the Meeting of the Book and Paper Specialty Group, AIC Annual Meeting, Milwaukee, May 27-30, 1982 (http://cool.conversation-us.org/coolaic/sg/bpg/annual/v01/bp01-05.html).

Dang et al., "Alkaline peroxide treatment of ECF bleached softwood kraft pulps. Part 1. Characterizing the effect of alkaline peroxide treatment on carboxyl groups of fibers," Holzforschung,vol. 61, pp. 445-450, 2007.

Dang, "The Investigation of Carboxyl Groups of Pulp Fibers During Kraft Pulping, Alkaline Peroxide Bleaching, and TEMPO-mediated Oxication," Georgia Insitute of Technology, Aug. 2007.

Easty et al., "Estimation of Pulp Yield in Continuous Digesters from Carbohydrate and Lignin Determinations," TAPPI Journal 65(12):78-80 (1982).

(Continued)

*Primary Examiner* — Anthony Calandra
(74) *Attorney, Agent, or Firm* — Finnegan, Henderson, Farabow, Garrett & Dunner L.L.P.; Jeffrey A. Freeman; Ram W. Sabnis

(57) ABSTRACT

A pulp fiber with an enhanced carbonyl content resulting in improved antimicrobial, anti-yellowing and absorptive properties. Methods for making the kraft pulp fiber and products made from it are also described.

11 Claims, No Drawings

(56) References Cited

U.S. PATENT DOCUMENTS 4,869,783 A 9/1989 Prusas et al.
4,875,974 A 10/1989 Rich
4,889,595 A 12/1989 Herron et al.
5,002,635 A 3/1991 Gentile, Jr. et al.
5,087,324 A 2/1992 Awofeso et al.
5,296,099 A 3/1994 Griggs et al.
5,300,358 A 4/1994 Evers
5,302,248 A 4/1994 Weinstock et al.
5,346,589 A 9/1994 Braunstein et al.
5,383,964 A 1/1995 Suc et al.
5,447,602 A 9/1995 Sajbel et al.
5,460,924 A 10/1995 Buchanan et al.
5,522,967 A 6/1996 Shet
5,529,662 A 6/1996 Tan et al.
5,536,625 A 7/1996 Buchanan et al.
5,552,019 A 9/1996 Weinstock et al.
5,562,645 A 10/1996 Tanzer et al.
5,580,485 A 12/1996 Feringa et al.
5,593,543 A 1/1997 Balos et al.
5,607,546 A 3/1997 Hoglund et al.
5,630,906 A 5/1997 Boe et al.
5,639,348 A 6/1997 Payton et al.
5,703,225 A 12/1997 Shet et al.
5,766,159 A 6/1998 Martin et al.
5,780,618 A 7/1998 Banker et al.
5,853,428 A 12/1998 Collins et al.
5,863,389 A 1/1999 White et al.
5,876,625 A 3/1999 Collins et al.
5,994,531 A 11/1999 Doenges et al.
6,010,594 A 1/2000 Henricson et al.
6,048,437 A 4/2000 Fukushima et al.
6,063,982 A 5/2000 Martin et al.
6,099,586 A 8/2000 Collins et al.
6,100,441 A 8/2000 Blomstrom et al.
6,136,223 A 10/2000 Collins et al.
6,146,494 A 11/2000 Seger et al.
6,210,801 B1 4/2001 Luo et al.
6,214,164 B1 4/2001 Rantala
6,214,976 B1 4/2001 Watanabe et al.
6,221,487 B1 4/2001 Luo et al.
6,228,126 B1 5/2001 Cimecioglu et al.
6,235,392 B1 5/2001 Luo et al.
6,241,779 B1 6/2001 Collins et al.
6,258,207 B1 7/2001 Pan
6,302,997 B1 10/2001 Hurter et al.
6,306,253 B2 10/2001 Henricson
6,306,334 B1 10/2001 Luo et al.
6,319,361 B1 11/2001 Smith et al.
6,331,354 B1 12/2001 Sealey, II et al.
6,368,456 B1 4/2002 Cimecioglu et al.
6,379,494 B1 4/2002 Jewell et al.
6,398,908 B1 6/2002 Hermansson et al.
6,432,266 B1 8/2002 Fukushima et al.
6,436,238 B1 8/2002 Pitkanen et al.
6,440,523 B1 8/2002 Sealey, II et al.
6,440,547 B1 8/2002 Luo et al.
6,444,314 B1 9/2002 Luo et al.
6,458,245 B1 10/2002 Hoglund et al.
6,471,727 B2 10/2002 Luo et al.
6,491,788 B2 12/2002 Sealey, II et al.
6,511,930 B1 1/2003 Luo et al.
6,514,380 B1 2/2003 Laine et al.
6,514,613 B2 2/2003 Luo et al.
6,515,049 B1 2/2003 Doenges et al.
6,518,419 B1 2/2003 Van Der Lugt et al.
6,524,348 B1 2/2003 Jewell et al.
6,528,163 B2 3/2003 Sealey, II et al.
6,540,876 B1 4/2003 Cimecioglu et al.
6,541,627 B1 4/2003 Ono et al.
6,562,195 B2 5/2003 Cimecioglu et al.
6,582,559 B2 6/2003 Thornton et al.
6,586,588 B1 7/2003 Cimecioglu et al.
6,596,033 B1 7/2003 Luo et al.
6,605,181 B1 8/2003 Bergqvist et al.
6,605,350 B1 8/2003 Sealey, II et al.
6,627,749 B1 9/2003 Kumar
6,632,328 B2 10/2003 Wan et al.
6,635,755 B1 10/2003 Jaschinski et al.
6,685,856 B2 2/2004 Sealey, II et al.
6,686,039 B2 2/2004 Sealey, II et al.
6,686,040 B2 2/2004 Sealey, II et al.
6,686,464 B1 2/2004 Harding et al.
6,692,827 B2 2/2004 Luo et al.
6,695,950 B1 2/2004 Cimecioglu et al.
6,699,358 B1 3/2004 Evans et al.
6,706,237 B2 3/2004 Luo et al.
6,706,876 B2 3/2004 Luo et al.
6,716,976 B1 4/2004 Jetten et al.
6,743,332 B2 6/2004 Haynes et al.
6,765,042 B1 7/2004 Thornton et al.
6,770,168 B1 8/2004 Stigsson
6,770,755 B1 8/2004 Gunnars et al.
6,773,552 B1 8/2004 Albert et al.
6,773,648 B2 8/2004 Luo et al.
6,793,686 B2 9/2004 Cimecioglu et al.
6,797,113 B2 9/2004 Sealey, II et al.
6,821,383 B2 11/2004 Shore et al.
6,824,645 B2 11/2004 Jaschinski et al.
6,849,156 B2 2/2005 Besemer et al.
6,852,904 B2 2/2005 Sun et al.
6,861,023 B2 3/2005 Sealey, II et al.
6,872,821 B2 3/2005 Cimecioglu et al.
6,881,299 B2 4/2005 Parrish et al.
6,896,725 B2 5/2005 Thornton et al.
6,916,466 B2 7/2005 Besemer et al.
6,923,889 B2 8/2005 Huuskonen et al.
6,924,369 B2 8/2005 Doenges et al.
6,936,710 B2 8/2005 Bragt et al.
6,958,108 B1 10/2005 Vuorinen
6,987,181 B2 1/2006 Jaschinski et al.
7,001,483 B2 2/2006 Severeid et al.
7,019,191 B2 3/2006 Looney et al.
7,022,837 B2 4/2006 Harding et al.
7,067,444 B2 6/2006 Luo et al.
7,083,704 B2 8/2006 Sealey, II et al.
7,090,744 B2 8/2006 Sealey, II et al.
7,094,317 B2 8/2006 Lundberg et al.
7,161,005 B2 1/2007 Schlingloff et al.
7,247,722 B2 7/2007 Cimecioglu et al.
7,252,837 B2 8/2007 Guo et al.
7,279,071 B2 10/2007 Williams et al.
7,279,177 B2 10/2007 Looney et al.
7,326,317 B2 2/2008 Westermark et al.
7,390,566 B2 6/2008 Luo et al.
7,411,110 B2 8/2008 Sawyer et al.
7,455,902 B2 11/2008 Weerawarna et al.
7,456,285 B2 11/2008 Schlingloff et al.
7,520,958 B2 4/2009 Tan et al.
7,541,396 B2 6/2009 Luo et al.
7,608,167 B2 10/2009 Luo et al.
7,692,004 B2 4/2010 Schlingloff et al.
7,700,764 B2 4/2010 Heijnesson-Hulten
7,708,214 B2 5/2010 Medoff
7,727,945 B2 6/2010 Rodrigues et al.
7,867,358 B2 1/2011 Medoff
7,867,359 B2 1/2011 Medoff
7,939,101 B2 5/2011 Obae et al.
7,947,292 B2 5/2011 Besemer et al.
7,955,536 B2 6/2011 Sawyer et al.
7,971,809 B2 7/2011 Medoff
7,976,676 B2 7/2011 Yin et al.
8,007,635 B2 8/2011 Tan et al.
8,029,896 B2 10/2011 Kumamoto et al.
8,044,013 B2 10/2011 Schlingloff et al.
8,057,636 B2 11/2011 Vinson et al.
8,084,391 B2 12/2011 Weerawarna
8,282,774 B2 10/2012 Tan et al.
8,372,765 B2 2/2013 Braig et al.
2001/0025695 A1 10/2001 Patt et al.
2001/0028955 A1 10/2001 Luo et al.
2001/0050153 A1 12/2001 Wajer et al.
2002/0005262 A1 1/2002 Cimecioglu et al.
2002/0034638 A1 3/2002 Sealey, II et al.
2002/0144796 A1 10/2002 Wan et al.

(56) References Cited

U.S. PATENT DOCUMENTS

| | | | |
|---|---|---|---|
| 2002/0165110 | A1 | 11/2002 | Reinhardt et al. |
| 2003/0019596 | A1 | 1/2003 | Ragauskas et al. |
| 2003/0026828 | A1 | 2/2003 | Besemer et al. |
| 2003/0084983 | A1 | 5/2003 | Rangachari et al. |
| 2003/0208175 | A1 | 11/2003 | Gross et al. |
| 2004/0024375 | A1 | 2/2004 | Litvay |
| 2004/0154761 | A1 | 8/2004 | Duggirala et al. |
| 2004/0154765 | A1 | 8/2004 | Huuskonen et al. |
| 2005/0028956 | A1 | 2/2005 | Winslow |
| 2005/0051288 | A1 | 3/2005 | Yin |
| 2005/0061455 | A1 | 3/2005 | Tan et al. |
| 2005/0084412 | A1 | 4/2005 | MacDonald et al. |
| 2006/0004335 | A1 | 1/2006 | Wang et al. |
| 2006/0070711 | A1 | 4/2006 | Luo |
| 2006/0144535 | A1 | 7/2006 | Nguyen et al. |
| 2006/0159733 | A1 | 7/2006 | Pendharkar et al. |
| 2006/0260773 | A1 | 11/2006 | Tan et al. |
| 2007/0000627 | A1 | 1/2007 | Tan et al. |
| 2007/0051481 | A1 | 3/2007 | Tan et al. |
| 2007/0119556 | A1 | 5/2007 | Tan et al. |
| 2007/0125507 | A1 | 6/2007 | Walter et al. |
| 2007/0143932 | A1 | 6/2007 | Buchert et al. |
| 2007/0163735 | A1 | 7/2007 | Buchert et al. |
| 2007/0190110 | A1 | 8/2007 | Pameijer et al. |
| 2007/0199668 | A1 | 8/2007 | Scarpello et al. |
| 2007/0272377 | A1 | 11/2007 | Mei et al. |
| 2008/0188636 | A1 | 8/2008 | Argyropoulos et al. |
| 2008/0294132 | A1 | 11/2008 | Tan et al. |
| 2008/0308239 | A1 | 12/2008 | Hart et al. |
| 2009/0044345 | A1 | 2/2009 | Schlingloff et al. |
| 2009/0054863 | A1 | 2/2009 | Tan et al. |
| 2009/0165968 | A1 | 7/2009 | Tan et al. |
| 2009/0312537 | A1 | 12/2009 | Medoff |
| 2010/0055437 | A1 | 3/2010 | Fink et al. |
| 2010/0124583 | A1 | 5/2010 | Medoff |
| 2010/0206501 | A1 | 8/2010 | Medoff |
| 2010/0233481 | A1 | 9/2010 | Isogai et al. |
| 2010/0282422 | A1 | 11/2010 | Miyawaki et al. |
| 2010/0316863 | A1 | 12/2010 | Kumamoto et al. |
| 2010/0320156 | A1 | 12/2010 | Olaiya et al. |
| 2011/0139383 | A1 | 6/2011 | Medoff |
| 2011/0287275 | A1 | 11/2011 | Tan et al. |
| 2012/0004194 | A1 | 1/2012 | Lu et al. |
| 2013/0066291 | A1 | 3/2013 | Tan et al. |
| 2013/0203699 | A1 | 8/2013 | Nonni et al. |

FOREIGN PATENT DOCUMENTS

| | | | |
|---|---|---|---|
| CA | 2469922 | A1 | 7/2003 |
| CN | 102888775 | A | 1/2013 |
| DE | 19620241 | | 11/1997 |
| DE | 10123665 | | 11/2002 |
| EP | 0172135 | | 2/1986 |
| EP | 0480469 | | 4/1992 |
| EP | 0716182 | | 6/1996 |
| EP | 0647158 | | 8/1997 |
| EP | 0845966 | | 3/2000 |
| EP | 0999222 | | 5/2000 |
| EP | 1077285 | | 2/2001 |
| EP | 1106732 | | 6/2001 |
| EP | 1154074 | | 11/2001 |
| EP | 1156065 | | 11/2001 |
| EP | 1093467 | | 3/2002 |
| EP | 0889997 | | 7/2002 |
| EP | 0923635 | | 2/2003 |
| EP | 1300420 | | 4/2003 |
| EP | 0787231 | | 5/2003 |
| EP | 1228099 | | 9/2003 |
| EP | 1025305 | | 11/2003 |
| EP | 1068376 | | 11/2003 |
| EP | 0511695 | | 6/2004 |
| EP | 1430911 | | 6/2004 |
| EP | 1155039 | | 7/2004 |
| EP | 0863158 | | 11/2004 |
| EP | 1077286 | | 2/2005 |
| EP | 1541590 | | 6/2005 |
| EP | 1278913 | | 11/2005 |
| EP | 1155040 | | 4/2006 |
| EP | 1383857 | | 5/2006 |
| EP | 1245722 | | 6/2006 |
| EP | 1230456 | | 7/2006 |
| EP | 1676863 | | 7/2006 |
| EP | 1311717 | | 8/2006 |
| EP | 1137672 | | 12/2006 |
| EP | 1743906 | | 1/2007 |
| EP | 1668180 | | 8/2007 |
| EP | 1862587 | | 12/2007 |
| EP | 2084325 | | 4/2010 |
| EP | 2216345 | | 8/2010 |
| EP | 2226414 | | 9/2010 |
| EP | 1694711 | | 12/2010 |
| FR | 2688787 | | 9/1993 |
| GB | 555985 | | 9/1943 |
| JP | S58054089 | | 3/1983 |
| JP | 2001/115389 | | 4/2001 |
| JP | 2003/026701 | | 1/2003 |
| WO | WO 1992/014760 | | 9/1992 |
| WO | WO 1994/020673 | | 9/1994 |
| WO | WO 1994/021690 | | 9/1994 |
| WO | WO 1995/006157 | | 3/1995 |
| WO | WO 1995/026438 | | 10/1995 |
| WO | WO 1995/034628 | | 12/1995 |
| WO | WO 1995/035406 | | 12/1995 |
| WO | WO 1995/035408 | | 12/1995 |
| WO | WO 1996/009434 | | 3/1996 |
| WO | WO 1996/020667 | | 7/1996 |
| WO | WO 1996/038111 | | 12/1996 |
| WO | WO 1997/022749 | | 6/1997 |
| WO | WO 97/30208 | | 8/1997 |
| WO | WO 1998/003626 | | 1/1998 |
| WO | WO 1998/056981 | | 12/1998 |
| WO | WO 1999/009244 | | 2/1999 |
| WO | WO 1999/047733 | | 9/1999 |
| WO | WO 1999/057158 | | 11/1999 |
| WO | WO 1999/057370 | | 11/1999 |
| WO | WO 2000/026257 | | 5/2000 |
| WO | WO 00/47812 | | 8/2000 |
| WO | WO 2000/050462 | | 8/2000 |
| WO | WO 2000/050463 | | 8/2000 |
| WO | WO 2000/065145 | | 11/2000 |
| WO | WO 2001/029309 | | 4/2001 |
| WO | WO 2001/034656 | | 5/2001 |
| WO | WO 2001/034657 | | 5/2001 |
| WO | WO 2001/083887 | | 11/2001 |
| WO | WO 2001/088236 | | 11/2001 |
| WO | WO 2002/048196 | | 6/2002 |
| WO | WO 2002/048197 | | 6/2002 |
| WO | WO 2002/049565 | | 6/2002 |
| WO | WO 2002/086206 | | 10/2002 |
| WO | WO 2002/088289 | | 11/2002 |
| WO | WO 2002/095129 | | 11/2002 |
| WO | WO 2003/006739 | | 1/2003 |
| WO | WO 03/042451 | | 5/2003 |
| WO | WO 2003/042451 | | 5/2003 |
| WO | WO 2003/051410 | | 6/2003 |
| WO | WO 2003/053483 | | 7/2003 |
| WO | WO 2004/062703 | | 7/2004 |
| WO | WO 2005/028744 | | 3/2005 |
| WO | WO 2005/058972 | | 6/2005 |
| WO | WO 2005/068074 | | 7/2005 |
| WO | WO 2006/102543 | | 9/2006 |
| WO | WO 2006/119392 | | 11/2006 |
| WO | WO 2006/125517 | | 11/2006 |
| WO | WO 2006/127880 | | 11/2006 |
| WO | WO 2007/042192 | | 4/2007 |
| WO | WO 2007/090461 | | 8/2007 |
| WO | WO 2008/010187 | | 1/2008 |
| WO | WO 2008/098037 | | 8/2008 |
| WO | WO 2008/153565 | | 12/2008 |
| WO | WO 2008/154073 | | 12/2008 |
| WO | WO 2009/134746 | | 11/2009 |
| WO | WO 2010/025224 | | 3/2010 |
| WO | WO 2010/138941 | | 12/2010 |
| WO | WO 2011/002956 | | 1/2011 |

(56) References Cited

FOREIGN PATENT DOCUMENTS

| | | |
|---|---|---|
| WO | WO 2011/088889 | 7/2011 |
| WO | WO 2011/089123 | 7/2011 |
| WO | WO 2011/090425 | 7/2011 |
| WO | WO 2012/170183 | 12/2012 |
| WO | WO 2013/155190 | 10/2013 |

OTHER PUBLICATIONS

Edwards et al., "Research and Development of Active Cotton Wound Dressings," 2004 Belwide Cotton Conferences, San Antonio, TX.
ESM055B01, Econotech Aldehyde Test, referenced in U.S. Appl. No. 61/182,000, filed May 28, 2009.
fibersource.com, "Cellulose," [retrieved Sep. 12, 2013 from http:/www.fibersource.com/F-tutor/cellulose.htm], 5 pages.
Filho et al., "Hydrogen Peroxide in Chemical Pulp Bleaching—an overview," 2002 Congreso Iberoamericano de Invesigacion en cellulosa y Papel, CIADICYP, pp. 1-27.
Georgia-Pacific West, Permit Renewal Response to Comments, 2001.
Gullichsen et al., Chemical Pulping 6A, 1999, Fapet Oy, pp. A207 and A653.
Gullichsen, "Chemical Pulping," Papermaking Science and Technology, Book 6A, pp. A635-A665, 1992.
International Paper, http://web.archive.org/web/20051107013141/hhtp://www.internationalpaper.com/Paper/Paper%20Products/Pulp/Southern_Bleached_So.html, Nov. 7, 2005.
Kennedy et al., The Chemistry and Processing of Wood and Plant Fibrous Materials, p. 155, Woodhead Publishing Ltd, Abington Hall, Abington, Cambridge CBI 6AH, England, 1996.
Kirk, T.K., et al. Characteristics of Cotton Cellulose Depolymerized by a Brown-Rot Fungus, by Acid, or by Chemical Oxidants, Holzforschung, vol. 45, No. 4 (1991) pp. 239-244.
Kubelka et al., "Delignification with Acidic Hydrogen Peroxide Activated by Molybdate," Journal of Pulp and Paper Science: vol. 18, No. 3, May 1992, pp. J108-J114.
Lapierre et al., "The Effect of Magnesium Ions and Chelants on Peroxide Bleaching," Holzforschung, vol. 57, No. 6, pp. 627-633, 2003.
Lenntech BV, http:/www.lentech.com/Fenton-reaction.htm [downloaded from www.archive.org], Jun. 28, 2003 [retrieved Sep. 12, 2013], whole document.
Morton, J.H., The Chemistry and Processing of Wood and Plant Fibrous Materials, Woodhead Publishing Ltd. (1996), pp. 151-158.
Qian et al., Journal of Wood Chemistry and Technology (2002), vol. 22, No. 4, pp. 267-284.
Qian, "The Chemical Mechanism of a Brown-Rot Decay Mimtic System and its Applicationi n paper Recycling Processes," [Chapter 4: The Effects of Chelator Mediated Fenton System on the Fiber and Paper Properties of Hardwood Kraft Pulp], 2001, *Electronic Theses and Dissertations*, Paper 505.
Ragauskas, Copper Number—Carbonyl Content of Pulp Fibers, document date "created" identified as May 12, 2007.
Rahmawati et al., "Pulp bleaching by hydrogen peroxide activated with copper 2,2_-dipyridylamine and 4-aminopyridine complexes," 2005, Chemical Engineering Journal, vol. 112, pp. 167-171.
Rapson, W. Howard and Irving H. Spinner, Chapter 14 in The Bleaching of Pulp (1963).
Rohrling et al., "A novel method for the determination of carbonyl groups in cellulosics by fluorescence labeling. 2. Validation and applications," Biomacromolecules Sep.-Oct. 2002; 3(5): 969-975.
Ruuttunen et al., "Concomitant Usage of Transition Metal Polyanions as Catalysts in Oxygen Delignification: Laboratory Bleaching Trials," 2006, Appita Journal, pp. 1-14.
Shenai, "Studies in Chemically Modified Celluloses. IX. Oxidation of Cellulose in the Presence of Chelating Agents," 1976, Journal of Applied Polymer Science, vol. 20, pp. 385-391.
Smook, Handbook for Pulp and Paper Technologists, 1992, Angus Wilde Publications, 2nd edition, Chapter 16, pp. 228-263.
Smook, Handbook for Pulp Paper Technologist, 1992, Angus Wilde Publications, 2nd Edition, Chapter 13, pp. 194-208.
Smook, Handbook of Pulp & Paper Terminology, 1990, pp. 89-90.
Song et al., Novel antiviral activity of dialdehyde starch, Electronic J. Biotech., vol. 12, No. 2, 2009.
Suchy et al., "Catalysis and Activation of Oxygen and Peroxide Delignification of Chemical Pulps; A Review," Miscellaneous Report, Pulp and Paper Research Institute of Canada, 1999, pp. 1-32.
Sun et al., "The effect of metal ions on the reaction of hydrogen peroxide with Kraft lignin model compounds" 1999, Can. J. Chem, vol. 77 (pp. 667-675).
Wojciak et al., "Direct Characterization of Hydrogen Peroxide Bleached Thermomechanial Pulp Using Spectroscopic Methods," J. Phys. Chem. A., vol. 111, pp. 10530-10536, 2007.
Zeronian et al., "Bleaching of cellulose by hydrogen peroxide," Cellulose, 1995, pp. 265-272.
English-language abstract of CN102888775A published Jan. 23, 2013.
English-language abstract of DE10123665 published Nov. 21, 2002.
International Search Report dated Oct. 20, 2014 in corresponding Application No. PCT/IB2014/000993.

METHOD OF MAKING A HIGHLY FUNCTIONAL, LOW VISCOSITY KRAFT FIBER USING AN ACIDIC BLEACHING SEQUENCE AND A FIBER MADE BY THE PROCESS

CROSS REFERENCE TO RELATED APPLICATIONS

This application is a national phase application based on PCT/IB2014/000993, filed Feb. 24, 2014, which claims the benefit of U.S. Provisional Application No. 61/785,075, filed Mar. 14, 2013, the contents of all of which are incorporated herein by reference.

This disclosure relates to a modified kraft fiber having improved functionality based upon the presence of carboxyl and/or carbonyl groups, for example, aldehyde and ketone groups. More particularly, this disclosure relates to a kraft fiber, e.g., softwood fiber, that has been oxidized multiple times to result in a unique set of characteristics, improving its performance over other previously treated fiber.

This disclosure further relates to chemically modified cellulose fiber derived from bleached softwood that has enhanced carboxyl and carbonyl content, making it suitable for use as a chemical cellulose feedstock in the production of cellulose derivatives including cellulose ethers, esters, and viscose, as fluff pulp in absorbent products, and in other consumer product applications.

This disclosure also relates to methods for producing the improved fiber described. The fiber, described, is subjected to digestion and oxygen delignification, followed by bleaching. According to one embodiment, the fiber is subjected to at least two catalytic oxidation treatments during the bleaching sequence. In some embodiments, the fiber is oxidized with a combination of hydrogen peroxide and iron or copper and then further bleached to provide a fiber with appropriate brightness characteristics, for example brightness comparable to standard bleached fiber. Further, at least one process is disclosed that can provide the improved beneficial characteristics mentioned above. The fiber can be oxidized in a kraft process, such as a kraft bleaching process. Still a further embodiment relates to a process including five-stage bleaching comprising a sequence of $D_0$E1D1E2D2, where both of the E1 or E2 stages comprises the catalytic oxidation treatment.

This disclosure also relates to a method for controlling the functionality imparted to a kraft fiber by subjecting the fiber to multiple oxidation treatments until the desired functionality is achieved. According to one embodiment, the fiber is subjected to a sequence of oxidation steps that vary by strength in order to moderate and control the functionality that is imparted to the fiber. For example, a weak oxidation followed by a strong oxidation may increase carboxyl and aldehyde functionality. Alternatively, a strong oxidation followed by a weak oxidation may increase conversion of aldehyde groups to carboxyl groups. Chlorine dioxide added during a strong oxidation in the E1 stage of a five-stage bleaching process forms chlorous acid, which oxidizes aldehyde groups to carboxyl groups.

Finally, this disclosure relates to products produced using the improved modified kraft fiber as described.

Cellulose fiber and derivatives are widely used in paper, absorbent products, food or food-related applications, pharmaceuticals, and in industrial applications. The main sources of cellulose fiber are wood pulp and cotton. The cellulose source and the cellulose processing conditions generally dictate the cellulose fiber characteristics, and therefore, the fiber's applicability for certain end uses. A need exists for cellulose fiber that is relatively inexpensive to process, yet is highly versatile, enabling its use in a variety of applications.

Kraft fiber, produced by a chemical kraft pulping method, provides an inexpensive source of cellulose fiber that generally provides final products with good brightness and strength characteristics. As such, it is widely used in paper applications. However, standard kraft fiber has limited applicability in downstream applications, such as cellulose derivative production, due to the chemical structure of the cellulose resulting from standard kraft pulping and bleaching. In general, standard kraft fiber contains too much residual hemi-cellulose and other naturally occurring materials that may interfere with the subsequent physical and/or chemical modification of the fiber. Moreover, standard kraft fiber has limited chemical functionality, and is generally rigid and not highly compressible.

In the standard kraft process a chemical reagent referred to as "white liquor" is combined with wood chips in a digester to carry out delignification. Delignification refers to the process whereby lignin bound to the cellulose fiber is removed due to its high solubility in hot alkaline solution. This process is often referred to as "cooking." Typically, the white liquor is an alkaline aqueous solution of sodium hydroxide (NaOH) and sodium sulfide ($Na_2S$). Depending upon the wood species used and the desired end product, white liquor is added to the wood chips in sufficient quantity to provide a desired total alkali charge based on the dried weight of the wood.

Generally, the temperature of the wood/liquor mixture in the digester is maintained at about 145° C. to 170° C. for a total reaction time of about 1-3 hours. When digestion is complete, the resulting kraft wood pulp is separated from the spent liquor (black liquor) which includes the used chemicals and dissolved lignin. Conventionally, the black liquor is burnt in a kraft recovery process to recover the sodium and sulphur chemicals for reuse.

At this stage, the kraft pulp exhibits a characteristic brownish color due to lignin residues that remain on the cellulose fiber. Following digestion and washing, the fiber is often bleached to remove additional lignin and whiten and brighten the fiber. Because bleaching chemicals are much more expensive than cooking chemicals, typically, as much lignin as possible is removed during the cooking process. However, it is understood that these processes need to be balanced because removing too much lignin can increase cellulose degradation. The typical Kappa number (the measure used to determine the amount of residual lignin in pulp) of softwood after cooking and prior to bleaching is in the range of 28 to 32.

Following digestion and washing, the fiber is generally bleached in multi-stage sequences, which traditionally comprise strongly acidic and strongly alkaline bleaching steps, including at least one alkaline step at or near the end of the bleaching sequence. Bleaching of wood pulp is generally conducted with the aim of selectively increasing the whiteness or brightness of the pulp, typically by removing lignin and other impurities, without negatively affecting physical properties. Bleaching of chemical pulps, such as kraft pulps, generally requires several different bleaching stages to achieve a desired brightness with good selectivity. Typically, a bleaching sequence employs stages conducted at alternating pH ranges. This alternation aids in the removal of impurities generated in the bleaching sequence, for example, by solubilizing the products of lignin breakdown. Thus, in general, it is expected that using a series of acidic stages in a bleaching sequence, such as three acidic stages in sequence, would not provide the same brightness as alternating acidic/alkaline stages, such as acidic-alkaline-acidic. For instance, a typical DEDED sequence produces a brighter product than a DEDAD sequence (where A refers to an acid treatment).

Cellulose exists generally as a polymer chain comprising hundreds to tens of thousands of glucose units. Cellulose may be oxidized to modify its functionality. Various methods of oxidizing cellulose are known. In cellulose oxidation, hydroxyl groups of the glycosides of the cellulose chains can be converted, for example, to carbonyl groups such as aldehyde groups or carboxylic acid groups. Depending on the oxidation method and conditions used, the type, degree, and location of the carbonyl modifications may vary. It is known that certain oxidation conditions may degrade the cellulose chains themselves, for example by cleaving the glycosidic rings in the cellulose chain, resulting in depolymerization. In most instances, depolymerized cellulose not only has a reduced viscosity, but also has a shorter fiber length than the starting cellulosic material. When cellulose is degraded, such as by depolymerizing and/or significantly reducing the fiber length and/or the fiber strength, it may be difficult to process and/or may be unsuitable for many downstream applications. A need remains for methods of modifying cellulose fiber that may improve both carboxylic acid and aldehyde functionalities, which methods do not extensively degrade the cellulose fiber.

Various attempts have been made to oxidize cellulose to provide both carboxylic and aldehydic functionality to the cellulose chain without degrading the cellulose fiber. In many cellulose oxidation methods, it has been difficult to control or limit the degradation of the cellulose when aldehyde groups are present on the cellulose. Previous attempts at resolving these issues have included the use of multi-step oxidation processes, for instance site-specifically modifying certain carbonyl groups in one step and oxidizing other hydroxyl groups in another step, and/or providing mediating agents and/or protecting agents, all of which may impart extra cost and by-products to a cellulose oxidation process. Thus, there exists a need for methods of modifying cellulose that are cost effective and that can be carried out within the equipment and processes that generally exist for the production of kraft fiber.

In addition to the difficulties in controlling the chemical structure of cellulose oxidation products, and the degradation of those products, it is known that the method of oxidation may affect other properties, including chemical and physical properties and/or impurities in the final products. For instance, the method of oxidation may affect the degree of crystallinity, the hemi-cellulose content, the color, and/or the levels of impurities in the final product and the yellowing characteristics of the fiber. Ultimately, the method of oxidation may impact the ability to process the cellulose product for industrial or other applications.

Traditionally, cellulose sources that were useful in the production of absorbent products or tissue were not also useful in the production of downstream cellulose derivatives, such as cellulose ethers and cellulose esters. The production of low viscosity cellulose derivatives from high viscosity cellulose raw materials, such as standard kraft fiber, requires additional manufacturing steps that would add significant cost while imparting unwanted by-products and reducing the overall quality of the cellulose derivative. Cotton linter and high alpha cellulose content sulfite pulps are typically used in the manufacture of cellulose derivatives such as cellulose ethers and esters. However, production of cotton linters and sulfite fiber with a high degree of polymerization (DP) and/or viscosity is expensive due to 1) the cost of the starting material, in the case of cotton; 2) the high energy, chemical, and environmental costs of pulping and bleaching, in the case of sulfite pulps; and 3) the extensive purifying processes required, which applies in both cases. In addition to the high cost, there is a dwindling supply of sulfite pulps available to the market. Therefore, these fibers are very expensive, and have limited applicability in pulp and paper applications, for example, where higher purity or higher viscosity pulps may be required. For cellulose derivative manufacturers these pulps constitute a significant portion of their overall manufacturing cost. Thus, there exists a need for high purity, white, bright, stable against yellowing, low cost fibers, such as a kraft fiber, that may be used in the production of cellulose derivatives.

There is also a need for inexpensive cellulose materials that can be used in the manufacture of microcrystalline cellulose. Microcrystalline cellulose is widely used in food, pharmaceutical, cosmetic, and industrial applications, and is a purified crystalline form of partially depolymerized cellulose. The use of kraft fiber in microcrystalline cellulose production, without the addition of extensive post-bleaching processing steps, has heretofore been limited. Microcrystalline cellulose production generally requires a highly purified cellulosic starting material, which is acid hydrolyzed to remove amorphous segments of the cellulose chain. See U.S. Pat. No. 2,978,446 to Battista et al. and U.S. Pat. No. 5,346,589 to Braunstein et al. A low degree of polymerization of the chains upon removal of the amorphous segments of cellulose, termed the "level-off DP," is frequently a starting point for microcrystalline cellulose production and its numerical value depends primarily on the source and the processing of the cellulose fibers. The dissolution of the non-crystalline segments from standard kraft fiber generally degrades the fiber to an extent that renders it unsuitable for most applications because of at least one of 1) remaining impurities; 2) a lack of sufficiently long crystalline segments; or 3) it results in a cellulose fiber having too high a degree of polymerization, typically in the range of 200 to 400, to make it useful in the production of microcrystalline cellulose. Kraft fiber having improved carbonyl and carboxyl functionality as well as an increased alpha cellulose content, for example, would be desirable, as the kraft fiber may provide greater versatility in microcrystalline cellulose production and applications.

In the present disclosure, oxidation of the kraft fiber may be controlled to impart enhanced/controlled functionality making it possible to improve/control the desired fiber properties, including but not limited to viscosity, odor control, and antimicrobial and antibacterial properties. Fiber of the present disclosure overcomes certain limitations associated with known kraft fiber discussed herein.

The fiber of the present invention can be cost-effectively produced with the oxidation being carried out before, during or after the bleaching sequence, or some combination thereof. According to one embodiment, it was quite surprising that a bleaching sequence where the alkaline bleaching stages were completely converted to acidic oxidation stages still resulted in a white, bright product.

DESCRIPTION

I. Methods

The present disclosure provides novel methods for producing cellulose fiber. The method comprises subjecting cellulose to a kraft pulping step, an oxygen delignification step, and a bleaching sequence. Similar pulping and bleaching processes are disclosed in published International Application No. WO 2010/138941 and WO/2012/170183, which are incorporated by reference in their entirety. Fiber produced under the conditions as described in the instant application exhibits the same high whiteness and high brightness while having enhanced functionality.

The present disclosure provides novel methods for producing cellulose fiber. The method comprises subjecting cellulose to a kraft pulping step, an oxygen delignification step, and a bleaching sequence which includes at least two catalytic oxidation stage. In one embodiment, the conditions under which the cellulose is processed result in softwood fiber exhibiting high brightness and low viscosity (ultra low DP) with enhanced functionality and a reduced tendency of the fiber to yellow upon exposure to heat, light and/or chemical treatment.

The cellulose fiber used in the methods described herein may be derived from softwood fiber, hardwood fiber, and mixtures thereof. In some embodiments, the modified cellulose fiber is derived from softwood, such as southern pine. In some embodiments, the modified cellulose fiber is derived from hardwood, such as eucalyptus. In some embodiments, the modified cellulose fiber is derived from a mixture of softwood and hardwood. In yet another embodiment, the modified cellulose fiber is derived from cellulose fiber that has previously been subjected to all or part of a kraft process, i.e., kraft fiber.

References in this disclosure to "cellulose fiber," "kraft fiber," "pulp fiber" or "pulp" are interchangeable except where specifically indicated to be different or where one of ordinary skill in the art would understand them to be different. As used herein "modified kraft fiber," i.e., fiber which has been cooked, bleached and oxidized in accordance with the present disclosure may be used interchangeably with "kraft fiber" or "pulp fiber" to the extent that the context warrants it.

The present disclosure provides novel methods for treating cellulose fiber. In some embodiments, the disclosure provides a method of modifying cellulose fiber, comprising providing cellulose fiber, and oxidizing the cellulose fiber. As used herein, "oxidized," "catalytically oxidized," "catalytic oxidation" and "oxidation" are all understood to be interchangeable and refer to treatment of cellulose fiber with at least one metal catalyst, such as iron or copper and at least one peroxide, such as hydrogen peroxide, such that at least some of the hydroxyl groups of the cellulose fibers are oxidized. The phrase "iron or copper" and similarly "iron (or copper)" mean "iron or copper or a combination thereof." In some embodiments, the oxidation comprises simultaneously increasing carboxylic acid and aldehyde content of the cellulose fiber.

References in this disclosure to "modified fiber," "chemically modified fiber," "oxidized fiber," or "fiber having functionality" all refer to a fiber that has been treated to modify the presence of carbonyl and/or carboxyl groups. These terms are interchangeable except where specifically indicated to be different or where one of ordinary skill in the art would understand them to be different.

In one embodiment, cellulose is digested using any method that is known in the art. A typical method of digestion includes the removal of lignin from cellulose fiber in hot alkaline solution. This process is often referred to as "cooking." Typically, the white liquor is an alkaline aqueous solution of sodium hydroxide (NaOH) and sodium sulfide ($Na_2S$). Generally, the temperature of the wood/liquor mixture in the digester is maintained at about 145° C. to 170° C. for a total reaction time of about 1-3 hours. When digestion is complete, the resulting kraft wood pulp is separated from the spent liquor (black liquor) which includes the used chemicals and dissolved lignin.

Digestion may be carried out with our without oxygen delignification. The typical Kappa number (the measure used to determine the amount of residual lignin in pulp) of the pulp after cooking, and optionally oxygen delignification, and prior to bleaching is in the range of 28 to 32.

According to another embodiment, preferably southern pine, is digested in a two-vessel hydraulic digester with, Lo-Solids® cooking to a kappa number ranging from about 13 to about 21. The resulting pulp is subjected to oxygen delignification until it reaches a kappa number of about 8 or below, for example, 6.5 or below. The cellulose pulp is then bleached in a multi-stage bleaching sequence which includes at least one catalytic oxidation stage.

In one embodiment, the method comprises digesting the cellulose fiber in a continuous digester with a co-current, down-flow arrangement. The effective alkali ("EA") of the white liquor charge is at least about 15% on pulp, for example, at least about 15.5% on pulp, for example at least about 16% on pulp, for example, at least about 16.4% on pulp, for example at least about 17% on pulp, for example at least about 18% on pulp, for example, at least about 18.5% on pulp. As used herein a "% on pulp" refers to an amount based on the dry weight of the kraft pulp. In one embodiment, the white liquor charge is divided with a portion of the white liquor being applied to the cellulose in the impregnator and the remainder of the white liquor being applied to the pulp in the digester. According to one embodiment, the white liquor is applied in a 50:50 ratio. In another embodiment, the white liquor is applied in a range of from 90:10 to 30:70, for example in a range from 50:50 to 70:30, for example 60:40. According to one embodiment, the white liquor is added to the digester in a series of stages. According to one embodiment, digestion is carried out at a temperature between about 160° C. to about 168° C., for example, from about 163° C. to about 168° C., for example, from about 166° C. to about 168° C., and the cellulose is treated until a target kappa number between about 13 and about 21 is reached. It is believed that the higher than normal effective alkali ("EA") and higher temperatures than used in the prior art achieve the lower than normal Kappa number.

According to one embodiment of the invention, the digester is run with an increase in push flow which increases the liquid to wood ratio as the cellulose enters the digester. This addition of white liquor is believed to assist in maintaining the digester at a hydraulic equilibrium and assists in achieving a continuous down-flow condition in the digester.

In one embodiment, the method comprises oxygen delignifying the cellulose fiber after it has been cooked to a kappa number from about 13 to about 21 to further reduce the lignin content and further reduce the kappa number, prior to bleaching. Oxygen delignification can be performed by any method known to those of ordinary skill in the art. For instance, oxygen delignification may be carried out in a conventional two-stage oxygen delignification process. Advantageously, the delignification is carried out to a target kappa number of about 8 or lower, for example about 6.5 or lower, for example about 5 to about 8.

In one embodiment, during oxygen delignification, the applied oxygen is less than about 3% on pulp, for example, less than about 2.4% on pulp, for example, less than about 2% on pulp, for example less than about 1.8% on pulp, for example less than about 1.6% on pulp. According to one embodiment, fresh caustic is added to the cellulose during oxygen delignification. Fresh caustic may be added in an amount of from about 2% on pulp to about 3.8% on pulp, for example, from about 3% on pulp to about 3.2% on pulp. According to one embodiment, the ratio of oxygen to caustic is reduced over standard kraft production; however the absolute amount of oxygen remains the same. Delignification may be carried out at a temperature of from about 85° C. to about 104° C., for example, from about 90° C. to about 102° C., for example, from about 96° C. to about 102° C., for example about 90° C. to about 96° C.

After the fiber has reached the desired Kappa Number of about 8 or less, for example, 6.5 or less, the fiber is subjected to a multi-stage bleaching sequence. The stages of the multi-stage bleaching sequence may include any conventional or after discovered series of stages and may be conducted under conventional conditions In some embodiments, prior to bleaching the pH of the cellulose is adjusted to a pH ranging from about 2 to about 6, for example from about 2 to about 5 or from about 2 to about 4, or from about 2 to about 3.

The pH can be adjusted using any suitable acid, as a person of skill would recognize, for example, sulfuric acid or hydrochloric acid or filtrate from an acidic bleach stage of a bleaching process, such as a chlorine dioxide (D) stage of a multi-stage bleaching process. For example, the cellulose fiber may be acidified by adding an extraneous acid. Examples of extraneous acids are known in the art and include, but are not limited to, sulfuric acid, hydrochloric acid, and carbonic acid. In some embodiments, the cellulose fiber is acidified with acidic filtrate, such as waste filtrate, from a bleaching step. In at least one embodiment, the cellulose fiber is acidified with acidic filtrate from a D stage of a multi-stage bleaching process.

The fiber, described, is subjected to a catalytic oxidation treatment. In some embodiments, the fiber is oxidized with iron and/or and a peroxide.

Oxidation of cellulose fiber involves treating the cellulose fiber with at least a catalytic amount of a metal catalyst, such as iron or copper and a peroxygen, such as hydrogen peroxide. In at least one embodiment, the method comprises oxidizing cellulose fiber with iron and hydrogen peroxide. The source of iron can be any suitable source, as a person of skill would recognize, such as for example ferrous sulfate (for example ferrous sulfate heptahydrate), ferrous chloride, ferrous ammonium sulfate, ferric chloride, ferric ammonium sulfate, or ferric ammonium citrate.

In some embodiments, the method comprises oxidizing the cellulose fiber with copper and hydrogen peroxide. Similarly, the source of copper can be any suitable source as a person of skill would recognize. Finally, in some embodiments, the method comprises oxidizing the cellulose fiber with a combination of copper and iron and hydrogen peroxide.

When cellulose fiber is oxidized, it is done in an acidic environment. The fiber should not be subjected to substantially alkaline conditions during the oxidation. In some embodiments, the method comprises oxidizing cellulose fiber at an acidic pH. In some embodiments, the method comprises providing cellulose fiber, acidifying the cellulose fiber, and then oxidizing the cellulose fiber at acidic pH. In some embodiments, the pH ranges from about 2 to about 6, for example from about 2 to about 5 or from about 2 to about 4.

In some embodiments, the method comprises oxidizing the cellulose fiber in two or more stages of a multi-stage bleaching sequence. In other embodiments, the oxidation may be carried out in two stages chosen from one or more oxidation stages before the first bleaching stage, one or more oxidation stages within the bleaching sequence, and oxidation in a stage following the bleaching stage. In some embodiments, the cellulose fiber may be oxidized in both the second stage and the fourth stage of a multi-stage bleaching sequence, for example, a five-stage bleaching sequence. In some embodiments, the cellulose fiber may be further oxidized in one or more additional stages before or following the bleaching sequence.

In accordance with the disclosure, the multi-stage bleaching sequence can be any bleaching sequence. In at least one embodiment, the multi-stage bleaching sequence is a five-stage bleaching sequence. In some embodiments, the bleaching sequence is a DEDED sequence. In some embodiments, the bleaching sequence is a $D_0$E1D1E2D2 sequence. In some embodiments, the bleaching sequence is a $D_0$(EoP)D1E2D2 sequence. In some embodiments the bleaching sequence is a $D_0$(EO)D1E2D2.

The non-oxidation stages of a multi-stage bleaching sequence may include any conventional or after discovered series of stages and may be conducted under conventional conditions. In some embodiments, the oxidation is incorporated into the second and fourth stages of a multi-stage bleaching process. In some embodiments, the method is implemented in a five-stage bleaching process having a sequence of $D_0$E1D1E2D2, wherein the second (E1) and fourth stage (E2) are used for oxidizing kraft fiber. According to some embodiments, like the one described, the bleaching sequence does not have any alkaline stages. Therefore, in some embodiments, the present process is an acidic bleaching sequence. Further, contrary to what the art predicts, the acidic bleaching sequence does not suffer from a substantial loss of brightness.

In some embodiments, the kappa number increases after oxidation of the cellulose fiber. More specifically, one would typically expect a decrease in kappa number across an oxidation bleaching stage based upon the anticipated decrease in material, such as lignin, which reacts with the permanganate reagent. However, in the method as described herein, the kappa number of cellulose fiber may decrease because of the loss of impurities, e.g., lignin; however, the kappa number may increase because of the chemical modification of the fiber. Not wishing to be bound by theory, it is believed that the increased functionality of the modified cellulose provides additional sites that can react with the permanganate reagent. Accordingly, the kappa number of modified kraft fiber is elevated relative to the kappa number of standard kraft fiber.

An appropriate retention time in one or more oxidation stages is an amount of time that is sufficient to catalyze the hydrogen peroxide with the iron or copper. Such time will be easily ascertainable by a person of ordinary skill in the art.

In accordance with the disclosure, the oxidation is carried out for a time and at a temperature that is sufficient to produce the desired completion of the reaction. For example, the oxidation may be carried out at a temperature ranging from about 60 to about 90° C., and for a time ranging from about 40 to about 80 minutes. The desired time and temperature of the oxidation reaction will be readily ascertainable by a person of skill in the art.

The fiber of the present disclosure may be subjected to any traditional bleaching sequence using art recognized conditions. The bleaching conditions provided herein are merely exemplary.

According to one embodiment, the cellulose is subjected to a D(EoP)DE2D bleaching sequence. According to this embodiment, the first D stage ($D_0$) of the bleaching sequence is carried out at a temperature of at least about 57° C., for example at least about 60° C., for example, at least about 66° C., for example, at least about 71° C. and at a pH of less than about 3, for example about 2.5. Chlorine dioxide is applied in an amount of greater than about 0.6% on pulp, for example, greater than about 0.8% on pulp, for example about 0.9% on pulp. Acid is applied to the cellulose in an amount sufficient to maintain the pH, for example, in an amount of at least about 1% on pulp, for example, at least about 1.15% on pulp, for example, at least about 1.25% on pulp.

According to one embodiment, oxidation can be carried out in the $E_1$ stage ($E_1$), and may be carried out at a temperature of at least about 75° C., for example at least about 80° C., for example, at least about 82° C. and at a pH of less than about 3.5, for example, less than 3.0, for example, less than about 2.8. An iron catalyst is added in, for example, aqueous solution at a rate of from about 25 to about 200 ppm $Fe^{+2}$, for example, from 25 to 150 ppm, for example, from 50 to 100 ppm, iron on pulp. Hydrogen Peroxide is applied to the cellulose in an amount of less than about 3.0% on pulp, for example, less than about 2.5% on pulp, for example, less than about 2.0% on pulp, for example, from about 1.0% on pulp to about 2.0% on pulp. The skilled artisan would recognize that any known peroxygen compound could be used to replace some or all of the hydrogen peroxide In accordance with the disclosure, hydrogen peroxide is added to the cellulose fiber in acidic media in an amount sufficient to achieve the desired oxidation and/or degree of polymerization and/or viscosity of the final cellulose product. For example, peroxide can be added as a solution at a concentration from about 1% to about 50% by weight in an amount of from about 0.1 to about 2.5%, or from about 0.5% to about 1.5%, or from about 0.5% to about 1.0%, or from about 1.0% to about 2.0%, based on the dry weight of the pulp.

Iron or copper are added at least in an amount sufficient to catalyze the oxidation of the cellulose with peroxide. For example, iron can be added in an amount ranging from about 25 to about 200 ppm based on the dry weight of the kraft pulp, for example, from 25 to 150 ppm, for example, from about 50 to about 100 ppm, for example from about 100 to about 200. A person of skill in the art will be able to readily optimize the amount of iron or copper to achieve the desired level or amount of oxidation and/or degree of polymerization and/or viscosity of the final cellulose product.

In some embodiments, the method further involves adding heat, such as through steam, either before or after the addition of hydrogen peroxide.

According to one embodiment, the second D stage ($D_1$) of the bleaching sequence is carried out at a temperature of at least about 74° C., for example at least about 77° C., for example, at least about 79° C., for example, at least about 82° C. and at a pH of less than about 4, for example less than 3.5, for example less than 3.0. Chlorine dioxide is applied in an amount of less than about 1% on pulp, for example, less than about 0.8% on pulp, for example about 0.7% on pulp, for example less than about 0.6% on pulp. Caustic is applied to the cellulose in an amount effective to adjust to the desired pH, for example, in an amount of less than about 0.015% on pulp, for example, less than about 0.01% pulp, for example, about 0.0075% on pulp. The TAPPI viscosity of the pulp after this bleaching stage may be 9-12 mPa·s, for example or may be lower, for example 6.5 mPa·s or less.

According to one embodiment, oxidation is also carried out in the second E stage ($E_2$). The oxidation can be carried out at a temperature of at least about 74° C., for example at least about 79° C. and at a pH of greater than about 2.5, for example, greater than 2.9, for example about 3.3. An iron catalyst is added in, for example, aqueous solution at a rate of from about 25 to about 200 ppm $Fe^{+2}$, for example, from 25 to 150 ppm, for example, from 50 to 100 ppm, iron on pulp. Hydrogen Peroxide is applied to the cellulose in an amount of less than about 3.0% on pulp, for example, less than about 2.5% on pulp, for example, less than about 2.0% on pulp, for example, less than about 1.5% on pulp, for example about 1.0% on pulp. The skilled artisan would recognize that any known peroxygen compound could be used to replace some or all of the hydrogen peroxide. In some embodiments, the two oxidation stages vary by strength in order to moderate and control the functionality that is imparted to the fiber. For example, a weak oxidation followed by a strong oxidation may increase carboxyl and aldehyde functionality. Alternatively, a strong oxidation followed by a weak oxidation may increase conversion of aldehyde groups to carboxyl groups. Chlorine dioxide added during a strong oxidation in the E1 stage of a five-stage bleaching process forms chlorous acid, which oxidizes aldehyde groups to carboxyl groups. A person of skill in the art will be able to readily optimize the strength and order of the two oxidation stages to achieve the desired level or amount of oxidation and/or functionality of the final cellulose product.

In accordance with the disclosure, hydrogen peroxide is added to the cellulose fiber in acidic media in an amount sufficient to achieve the desired oxidation and/or degree of polymerization and/or viscosity of the final cellulose product. For example, peroxide can be added as a solution at a concentration from about 1% to about 50% by weight in an amount of from about 0.1 to about 2.5%, or from about 0.5% to about 1.5%, or from about 0.5% to about 1.0%, or from about 1.0% to about 2.0%, based on the dry weight of the pulp.

Iron or copper are added at least in an amount sufficient to catalyze the oxidation of the cellulose with peroxide. For example, iron can be added in an amount ranging from about 25 to about 200 ppm based on the dry weight of the kraft pulp, for example, from 25 to 150 ppm, for example, from about 50 to about 100 ppm, for example from about 100 to about 200. A person of skill in the art will be able to readily optimize the amount of iron or copper to achieve the desired level or amount of oxidation and/or degree of polymerization and/or viscosity of the final cellulose product.

In some embodiments, the method further involves adding heat, such as through steam, either before or after the addition of hydrogen peroxide.

In some embodiments, the final DP and/or viscosity of the pulp can be controlled by the amount of iron or copper and hydrogen peroxide and the robustness of the bleaching conditions prior to the oxidation step. A person of skill in the art will recognize that other properties of the modified kraft fiber of the disclosure may be affected by the amounts of catalyst and peroxide and the robustness of the bleaching conditions prior to the oxidation step. For example, a person of skill in the art may adjust the amounts of iron or copper and hydrogen peroxide and the robustness of the bleaching conditions prior to the oxidation step to target or achieve a desired brightness in the final product and/or a desired degree of polymerization or viscosity.

In some embodiments, a kraft pulp is acidified on a D1 stage washer, the iron source (or copper source) is also added to the kraft pulp on the D1 stage washer, the peroxide is added following the iron source (or copper source) at an addition point in the mixer or pump before the E2 stage tower, the kraft pulp is reacted in the E2 tower and washed on the E2 washer, and steam may optionally be added before the E2 tower in a steam mixer.

In some embodiments, iron (or copper) can be added up until the end of the D1 stage, or the iron (or copper) can also be added at the beginning of the E2 stage, provided that the pulp is acidified first (i.e., prior to addition of the iron (or copper)) at the D1 stage. Steam may be optionally added either before or after the addition of the peroxide.

For example, in some embodiments, the treatment with hydrogen peroxide in an acidic media with iron (or copper) may involve adjusting the pH of the kraft pulp to a pH ranging from about 2 to about 5, adding a source of iron (or copper) to the acidified pulp, and adding hydrogen peroxide to the kraft pulp.

According to one embodiment, the third D stage ($D_2$) of the bleaching sequence is carried out at a temperature of at least about 74° C., for example at least about 77° C., for example, at least about 79° C., for example, at least about 82° C. and at a pH of less than about 4, for example less than about 3.8. Chlorine dioxide is applied in an amount of less than about 0.5% on pulp, for example, less than about 0.3% on pulp, for example about 0.15% on pulp.

Alternatively, the multi-stage bleaching sequence may be altered to provide more robust bleaching conditions prior to oxidizing the cellulose fiber. In some embodiments, the method comprises providing more robust bleaching conditions prior to any oxidation step. More robust bleaching conditions may allow the degree of polymerization and/or viscosity of the cellulose fiber to be reduced in the oxidation step with lesser amounts of iron or copper and/or hydrogen peroxide. Thus, it may be possible to modify the bleaching sequence conditions so that the brightness and/or viscosity of the final cellulose product can be further controlled. For instance, reducing the amounts of peroxide and metal, while providing more robust bleaching conditions before oxidation, may provide a product with lower viscosity and higher brightness than an oxidized product produced with identical oxidation conditions but with less robust bleaching. Such conditions may be advantageous in some embodiments, particularly in cellulose ether applications.

In some embodiments, for example, the method of preparing a modified cellulose fiber within the scope of the disclosure may involve acidifying the kraft pulp to a pH ranging from about 2 to about 5 (using for example sulfuric acid), mixing a source of iron (for example ferrous sulfate, for example ferrous sulfate heptahydrate) with the acidified kraft pulp at an application of from about 25 to about 250 ppm $Fe^{+2}$ based on the dry weight of the kraft pulp at a consistency ranging from about 1% to about 15% and also hydrogen peroxide, which can be added as a solution at a concentration of from about 1% to about 50% by weight and in an amount ranging from about 0.1% to about 2.5% based on the dry weight of the kraft pulp. In some embodiments, the ferrous sulfate solution is mixed with the kraft pulp at a consistency ranging from about 7% to about 15%. In some embodiments the acidic kraft pulp is mixed with the iron source and reacted with the hydrogen peroxide for a time period ranging from about 40 to about 90 minutes at a temperature ranging from about 60 to about 80° C., for example at a temperature of greater than about 75° C.

In some embodiments, each stage of the five-stage bleaching process includes at least a mixer, a reactor, and a washer (as is known to those of skill in the art).

Oxidations stages under the conditions described above may be added to the bleaching sequence either before bleaching begins or, for example, after the last bleaching stage of the bleaching sequence selected, e.g., after the fifth stage of a five stage bleaching sequence. The number of oxidation stages and the oxidation rates can be varied to control the modification of the fiber. Accordingly, by combining various oxidation stages, one can generally achieve the functionality of the fiber that is desired. For example, higher aldehyde content improves odor control and compression, but diminishes anti-yellowing stability. Likewise, increased carboxy functionality improves absorbent characteristics, wet and dry tensile strength and anti-yellowing stability. Controlling the level of oxidation as well as the specific functionality imparted (level of aldheydes, carbonyl groups or carboxyl groups) allows one to generate a preferred set of fiber qualities depending upon the end use desired.

Fiber produced as described may, in some embodiments, be treated with a surface active agent. The surface active agent for use in the present invention may be solid or liquid. The surface active agent can be any surface active agent, including by not limited to softeners, debonders, and surfactants that is not substantive to the fiber, i.e., which does not interfere with its specific absorption rate. As used herein a surface active agent that is "not substantive" to the fiber exhibits an increase in specific absorption rate of 30% or less as measured using the pfi test as described herein. According to one embodiment, the specific absorption rate is increased by 25% or less, such as 20% or less, such as 15% or less, such as 10% or less. Not wishing to be bound by theory, the addition of surfactant causes competition for the same sites on the cellulose as the test fluid. Thus, when a surfactant is too substantive, it reacts at too many sites reducing the absorption capability of the fiber.

As used herein PFI absorption is measured according to SCAN-C-33:80 Test Standard, Scandinavian Pulp, Paper and Board Testing Committee. The method is generally as follows. First, the sample is prepared using a PFI Pad Former. Turn on the vacuum and feed approximately 3.01 g fluff pulp into the pad former inlet. Turn off the vacuum, remove the test piece and place it on a balance to check the pad mass. Adjust the fluff mass to 3.00±0.01 g and record as $Mass_{dry}$. Place the fluff into the test cylinder. Place the fluff containing cylinder in the shallow perforated dish of an Absorption Tester and turn the water valve on. Gently apply a 500 g load to the fluff pad while lifting the test piece cylinder and promptly press the start button. The Tester will fun for 30 s before the display will read 00.00. When the display reads 20 seconds, record the dry pad height to the nearest 0.5 mm ($Height_{dry}$). When the display again reads 00.00, press the start button again to prompt the tray to automatically raise the water and then record the time display (absorption time, T). The Tester will continue to run for 30 seconds. The water tray will automatically lower and the time will run for another 30 S. When the display reads 20 s, record the wet pad height to the nearest 0.5 mm ($Height_{wet}$). Remove the sample holder, transfer the wet pad to the balance for measurement of $Mass_{wet}$ and shut off the water valve. Specific Absorption Rate (s/g) is $T/Mass_{dry}$. Specific Capacity (g/g) is $(Mass_{wet}-Mass_{dry})/Mass_{dry}$. Wet Bulk (cc/g) is $[19.64\ cm^2 \times Height_{wet}/3]/10$. Dry Bulk is $[19.64\ cm^2 \times Height_{dry}3]/10$. The reference standard for comparison with the surfactant treated fiber is an identical fiber without the addition of surfactant.

It is generally recognized that softeners and debonders are often available commercially only as complex mixtures rather than as single compounds. While the following discussion will focus on the predominant species, it should be understood that commercially available mixtures would generally be used in practice. Suitable softener, debonder and surfactants will be readily apparent to the skilled artisan and are widely reported in the literature.

Suitable surfactants include cationic surfactants, anionic, and nonionic surfactants that are not substantive to the fiber. According to one embodiment, the surfactant is a non-ionic surfactant. According to one embodiment, the surfactant is a cationic surfactant. According to one embodiment, the surfactant is a vegetable based surfactant, such as a vegetable based fatty acid, such as a vegetable based fatty acid quaternary ammonium salt. Such compounds include DB999 and DB1009, both available from Cellulose Solutions. Other surfactants may be including, but not limited to Berol 388 an ethoxylated nonylphenol ether from Akzo Nobel.

Biodegradable softeners can be utilized. Representative biodegradable cationic softeners/debonders are disclosed in U.S. Pat. Nos. 5,312,522; 5,415,737; 5,262,007; 5,264,082; and 5,223,096, all of which are incorporated herein by reference in their entirety. The compounds are biodegradable diesters of quaternary ammonia compounds, quaternized amine-esters, and biodegradable vegetable oil based esters functional with quaternary ammonium chloride and diester dierucyldimethyl ammonium chloride and are representative biodegradable softeners.

The surfactant is added in an amount of up to 6 lbs/ton, such as from 0.5 lbs/ton to 3 lbs/ton, such as from 0.5 lbs/ton to 2.5 lbs/ton such as from 0.5 lbs/ton to 2 lbs/ton, such as less than 2 lbs/ton.

The surface active agent may be added at any point prior to forming rolls, bales, or sheets of pulp. According to one embodiment, the surface active agent is added just prior to the headbox of the pulp machine, specifically at the inlet of the primary cleaner feed pump.

According to one embodiment, the fiber of the present invention has an improved filterability over the same fiber without the addition of surfactant when utilized in a viscose process. For example, the filterability of a viscose solution comprising fiber of the invention has a filterability that is at least 10% lower than a viscose solution made in the same way with the identical fiber without surfactant, such as at least 15% lower, such as at least 30% lower, such as at least 40% lower. Filterability of the viscose solution is measured by the following method. A solution is placed in a nitrogen pressurized (27 psi) vessel with a 1 and 3/16ths inch filtered orifice on the bottom—the filter media is as follows from outside to inside the vessel: a perforated metal disk, a 20 mesh stainless steel screen, muslin cloth, a Whatman 54 filter paper and a 2 layer knap flannel with the fuzzy side up toward the contents of the vessel. For 40 minutes the solution is allowed to filter through the media, then at 40 minutes for an additional 140 minutes the (so t=0 at 40 minutes) the volume of filtered solution is measured (weight) with the elapsed time as the X coordinate and the weight of filtered viscose as the Y coordinate—the slope of this plot is your filtration number. Recordings to be made at 10 minute intervals. The reference standard for comparison with the surfactant treated fiber is the identical fiber without the addition of surfactant.

According to one embodiment of the invention, the surfactant treated fiber of the invention exhibits a limited increase in specific absorption rate, e.g., less than 30% with a concurrent decrease in filterability, e.g., at least 10%. According to one embodiment, the surfactant treated fiber has an increased specific absorption rate of less than 30% and a decreased filterability of at least 20%, such as at least 30%, such as at least 40%. According to another embodiment, the surfactant treated fiber has an increased specific absorption rate of less than 25% and a decreased filterability of at least 10%, such as at least about 20%, such as at least 30%, such as at least 40%. According to yet another embodiment, the surfactant treated fiber has an increased specific absorption rate of less than 20% and a decreased filterability of at least 10%, such as at least about 20%, such as at least 30%, such as at least 40%. According to another embodiment, the surfactant treated fiber has an increased specific absorption rate of less than 15% and a decreased filterability of at least 10%, such as at least about 20%, such as at least 30%, such as at least 40%. According to still another embodiment, the surfactant treated fiber has an increased specific absorption rate of less than 10% and an decreased filterability of at least 10%, such as at least about 20%, such as at least 30%, such as at least 40%.

Heretofore the addition of cationic surfactant to pulp bound for the production of viscose was considered detrimental to viscose production. Cationic surfactants attach to the same sites on the cellulose that caustic must react with to begin the breakdown of the cellulose fiber. Thus, it has long been thought that cationic materials should not be used as pulp pre-treatments for fibers used in the production of viscose. Not wishing to be bound by theory it is believed that since the fibers produced according to the present invention differs from prior art fiber in their form, character and chemistry, the cationic surfactant is not binding in the same manner as it did to prior art fibers. Fiber according to the disclosure, when treated with a surfactant according to the invention separates the fiber in a way that improves caustic penetration and filterability. Thus, according to one embodiment fibers of the present disclosure can be used as a substitute for expensive cotton or sulfite fiber to a greater extent than either untreated fiber or prior art fiber has been.

In some embodiments, the disclosure provides a method for controlling odor, comprising providing a modified bleached kraft fiber according to the disclosure, and applying an odorant to the bleached kraft fiber such that the atmospheric amount of odorant is reduced in comparison with the atmospheric amount of odorant upon application of an equivalent amount of odorant to an equivalent weight of standard kraft fiber. In some embodiments the disclosure provides a method for controlling odor comprising inhibiting bacterial odor generation. In some embodiments, the disclosure provides a method for controlling odor comprising absorbing odorants, such as nitrogenous odorants, onto a modified kraft fiber. As used herein, "nitrogenous odorants" is understood to mean odorants comprising at least one nitrogen.

In some embodiments, the disclosure provides a method for producing fluff pulp, comprising providing kraft fiber of the disclosure and then producing a fluff pulp. For example, the method comprises bleaching kraft fiber in a multi-stage bleaching process, and then forming a fluff pulp. In at least one embodiment, the fiber is not refined after the multi-stage bleaching process.

In some embodiments, the kraft fiber is combined with at least one super absorbent polymer (SAP). In some embodiments, the SAP may by an odor reductant. Examples of SAP that can be used in accordance with the disclosure include, but are not limited to, Hysorb™ sold by the company BASF, Aqua Keep® sold by the company Sumitomo, and FAVOR®, sold by the company Evonik.

II. Kraft Fibers

Reference is made herein to "standard," "conventional," or "traditional," kraft fiber, kraft bleached fiber, kraft pulp or kraft bleached pulp. Such fiber or pulp is often described as a reference point for defining the improved properties of the present invention. As used herein, these terms are interchangeable and refer to the fiber or pulp which is identical in composition to and processed in a like standard manner. As used herein, a standard kraft process includes both a cooking stage and a bleaching stage under art recognized conditions. Standard kraft processing does not include a pre-hydrolysis stage prior to digestion or oxidation.

Physical characteristics (for example, purity, brightness, fiber length and viscosity) of the kraft cellulose fiber mentioned in the specification are measured in accordance with protocols provided in the Examples section.

In some embodiments, modified kraft fiber of the disclosure has a brightness equivalent to standard kraft fiber. In some embodiments, the modified cellulose fiber has a brightness of at least 86, 87, 88, 89, or 90 ISO. In some embodiments, the brightness ranges from about 85 to about 92, or from about 86 to about 90, or from about 86 to about 89, or from about 87 to about 89.

In some embodiments, cellulose according to the present disclosure has an R18 value in the range of from about 75% to about 90%, for instance R18 has a value ranging from about 80% to about 90%, for example, 87.5% to 88.2%, for example, at least about 87%, for example, at least about 87.5%, for example at least about 87.8%, for example at least about 88%.

In some embodiments, kraft fiber according to the disclosure has an R10 value ranging from about 65% to about 85%, for instance, R10 has a value ranging from about 75% to about 85%, for example, at least about 82%, for example, at least about 83%, for example, at least about 84%, for example, at least about 85%. The R18 and R10 content is described in TAPPI T235. R10 represents the residual undissolved material that is left after extraction of the pulp with 10 percent by weight caustic and R18 represents the residual amount of undissolved material left after extraction of the pulp with an 18% caustic solution. Generally, in a 10% caustic solution, hemicellulose and chemically degraded short chain cellulose are dissolved and removed in solution. In contrast, generally only hemicellulose is dissolved and removed in an 18% caustic solution. Thus, the difference between the R10 value and the R18 value, ($\Delta R = R18 - R10$), represents the amount of chemically degraded short chained cellulose that is present in the pulp sample.

In some embodiments, modified cellulose fiber has an S10 caustic solubility ranging from about 14% to about 20%, or from about 16% to about 19.5%. In some embodiments, modified cellulose fiber has an 518 caustic solubility ranging from less than about 16%, for example less than about 14.5%, for example, less than about 12.5%, for example, less than about 12.3%, for example, about 12%.

The present disclosure provides kraft fiber with low and ultra-low viscosity. Unless otherwise specified, "viscosity" as used herein refers to 0.5% Capillary CED viscosity measured according to TAPPI T230-om99 as referenced in the protocols.

Unless otherwise specified, "DP" as used herein refers to average degree of polymerization by weight (DPw) calculated from 0.5% Capillary CED viscosity measured according to TAPPI T230-om99. See, e.g., J.F. Cellucon Conference in *The Chemistry and Processing of Wood and Plant Fibrous Materials*, p. 155, test protocol 8, 1994 (Woodhead Publishing Ltd., Abington Hall, Abinton Cambridge CBI 6AH England, J. F. Kennedy et al. eds.) "Low DP" means a DP ranging from about 1160 to about 1860 or a viscosity ranging from about 7 to about 13 mPa·s, "Ultra low DP" fibers means a DP ranging from about 350 to about 1160 or a viscosity ranging from about 3 to about 7 mPa·s.

Without wishing to be bound by theory, it is believed that the fiber of the present invention presents an artificial Degree of Polymerization when DP is calculated via CED viscosity measured according to TAPPI T230-om99. Specifically, it is believed that the catalytic oxidation treatment of the fiber of the present invention doesn't break the cellulose down to the extent indicated by the measured DP, but instead largely has the effect of opening up bonds and adding substituents that make the cellulose more reactive, instead of cleaving the cellulose chain. It is further believed that the CED viscosity test (TAPPI T230-om99), which begins with the addition of caustic, has the effect of cleaving the cellulose chain at the new reactive sites, resulting in a cellulose polymer which has a much higher number of shorter segments than are found in the fiber's pre-testing state. This is confirmed by the fact that the fiber length is not significantly diminished during production.

In some embodiments, modified cellulose fiber has a viscosity ranging from about 2.0 mPa·s to about 6 mPa·s. In some embodiments, the viscosity ranges from about 2.5 mPa·s to about 5.0 mPa·s. In some embodiments, the viscosity ranges from about 2.5 mPa·s to about 4.0 mPa·s. In some embodiments, the viscosity ranges from about 2.0 mPa·s to about 4.0 mPa·s. In some embodiments, the viscosity is less than 6 mPa·s, less than 5.0 mPa·s, less than 4.0 mPa·s, or less than 3.0 mPa·s.

In some embodiments, kraft fiber of the disclosure is more compressible and/or embossable than standard kraft fiber. In some embodiments, kraft fiber may be used to produce structures that are thinner and/or have higher density than structures produced with equivalent amounts of standard kraft fiber.

In some embodiments, kraft fiber of the disclosure maintains its fiber length during the bleaching process.

"Fiber length" and "average fiber length" are used interchangeably when used to describe the property of a fiber and mean the length-weighted average fiber length. Therefore, for example, a fiber having an average fiber length of 2 mm should be understood to mean a fiber having a length-weighted average fiber length of 2 mm.

In some embodiments, when the kraft fiber is a softwood fiber, the cellulose fiber has an average fiber length, as measured in accordance with Test Protocol 12, described in the Example section below, that is about 2 mm or greater. In some embodiments, the average fiber length is no more than about 3.7 mm. In some embodiments, the average fiber length is at least about 2.2 mm, about 2.3 mm, about 2.4 mm, about 2.5 mm, about 2.6 mm, about 2.7 mm, about 2.8 mm, about 2.9 mm, about 3.0 mm, about 3.1 mm, about 3.2 mm, about 3.3 mm, about 3.4 mm, about 3.5 mm, about 3.6 mm, or about 3.7 mm. In some embodiments, the average fiber length ranges from about 2 mm to about 3.7 mm, or from about 2.2 mm to about 3.7 mm.

In some embodiments, modified kraft fiber of the disclosure has increased carboxyl content relative to standard kraft fiber.

In some embodiments, modified cellulose fiber has a carboxyl content ranging from about 4 meq/100 g to about 8 meq/100 g. In some embodiments, the carboxyl content ranges from about 5 meq/100 g to about 7 meq/100 g. In some embodiments, the carboxyl content is at least about 4 meq/100 g, for example, at least about 5 meq/100 g, for example, at least about 6 meq/100 g, for example, at least about 6.5 meq/100 g.

In some embodiments, modified cellulose fiber has a carbonyl content ranging from about 5 meq/100 g to about 10 meq/100 g. In some embodiments, the carbonyl content ranges from about 6 meq/100 g to about 10 meq/100 g. In some embodiments, the carbonyl content is greater than about 7 meq/100 g, for example, greater than about 8.0 meq/100 g, for example, greater than about 9.0 meq/100 g.

Kraft fiber of the disclosure may be more flexible than standard kraft fiber, and may elongate and/or bend and/or exhibit elasticity and/or increase wicking. Additionally, it is expected that the kraft fiber of the disclosure would be softer than standard kraft fiber, enhancing their applicability in absorbent product applications, for example, such as diaper and bandage applications.

In some embodiments, the modified cellulose fiber has a copper number less than about 2. In some embodiments, the copper number greater than about 4.0. In some embodiments, the copper number is greater than about 5.0, for example, greater than about 5.5.

In at least one embodiment, the hemicellulose content of the modified kraft fiber is substantially the same as standard unbleached kraft fiber. For example, the hemicellulose content for a softwood kraft fiber may range from about 12% to about 17%. For instance, the hemicellulose content of a hardwood kraft fiber may range from about 12.5% to about 16.5%.

III. Products Made from Kraft Fibers

The present disclosure provides products made from the modified kraft fiber described herein. In some embodiments, the products are those typically made from standard kraft fiber. In other embodiments, the products are those typically made from cotton linter, pre-hydrolysis kraft or sulfite pulp. More specifically, fiber of the present invention can be used, without further modification, in the production of absorbent products and as a starting material in the preparation of chemical derivatives, such as ethers and esters. Heretofore, fiber has not been available which has been useful to replace both high alpha content cellulose, such as cotton and sulfite pulp, as well as traditional kraft fiber.

Phrases such as "which can be substituted for cotton linter (or sulfite pulp) . . . " and "interchangeable with cotton linter (or sulfite pulp) . . . " and "which can be used in place of cotton linter (or sulfite pulp) . . . " and the like mean only that the fiber has properties suitable for use in the end application normally made using cotton linter (or sulfite pulp or pre-hydrolysis kraft fiber). The phrase is not intended to mean that the fiber necessarily has all the same characteristics as cotton linter (or sulfite pulp).

In some embodiments, the products are absorbent products, including, but not limited to, medical devices, including wound care (e.g. bandage), baby diapers nursing pads, adult incontinence products, feminine hygiene products, including, for example, sanitary napkins and tampons, air-laid non-woven products, air-laid composites, "table-top" wipers, napkin, tissue, towel and the like. Absorbent products according to the present disclosure may be disposable. In those embodiments, fiber according to the invention can be used as a whole or partial substitute for the bleached hardwood or softwood fiber that is typically used in the production of these products.

In some embodiments, the kraft fiber of the present invention is in the form of fluff pulp and has one or more properties that make the kraft fiber more effective than conventional fluff pulps in absorbent products. More specifically, kraft fiber of the present invention may have improved compressibility which makes it desirable as a substitute for currently available fluff pulp fiber. Because of the improved compressibility of the fiber of the present disclosure, it is useful in embodiments which seek to produce thinner, more compact absorbent structures. One skilled in the art, upon understanding the compressible nature of the fiber of the present disclosure, could readily envision absorbent products in which this fiber could be used. By way of example, in some embodiments, the disclosure provides an ultrathin hygiene product comprising the kraft fiber of the disclosure. Ultra-thin fluff cores are typically used in, for example, feminine hygiene products or baby diapers. Other products which could be produced with the fiber of the present disclosure could be anything requiring an absorbent core or a compressed absorbent layer. When compressed, fiber of the present invention exhibits no or no substantial loss of absorbency, but shows an improvement in flexibility.

In some embodiments, the kraft fiber is combined with at least one super absorbent polymer (SAP). In some embodiments, the SAP may by an odor reductant. Examples of SAP that can be used in accordance with the disclosure include, but are not limited to, Hysorb™ sold by the company BASF, Aqua Keep® sold by the company Sumitomo, and FAVOR®, sold by the company Evonik Fiber of the present invention may, without further modification, also be used in the production of absorbent products including, but not limited to, tissue, towel, napkin and other paper products which are formed on a traditional papermaking machine. Traditional papermaking processes involve the preparation of an aqueous fiber slurry which is typically deposited on a forming wire where the water is thereafter removed. The kraft fibers of the present disclosure may provide improved product characteristics in products including these fibers.

The cellulose fibers of the disclosure exhibit antiviral and/or antimicrobial activity. The cellulose fibers of the present invention are useful in the production of articles that would come into contact with microbes, viruses or bacteria and thus, would benefit from inhibition of the growth of those infectious agents. Absorbent articles or devices include bandages, bandaids, medical gauze, absorbent dressings and pads, medical gowning, paper for medical tables, and incontinence pads for hospital use, just to name a few. The fiber of the disclosure can be included within, e.g., can be a portion of, or can make-up the entire absorbent portion of the absorbent device. In some embodiments, the disclosure provides a method for controlling odor, comprising providing a oxidized bleached kraft fiber according to the disclosure, and applying an odorant to the bleached kraft fiber such that the atmospheric amount of odorant is reduced in comparison with the atmospheric amount of odorant upon application of an equivalent amount of odorant to an equivalent weight of standard kraft fiber. In some embodiments the disclosure provides a method for controlling odor comprising inhibiting bacterial odor generation. In some embodiments, the disclosure provides a method for controlling odor comprising absorbing odorants, such as nitrogenous odorants, onto a modified kraft fiber. As used herein, "nitrogenous odorants" is understood to mean odorants comprising at least one nitrogen.

IV. Acid/Alkaline Hydrolyzed Products

In some embodiments, this disclosure provides a modified kraft fiber that can be used as a substitute for cotton linter or sulfite pulp. In some embodiments, this disclosure provides a modified kraft fiber that can be used as a substitute for cotton linter or sulfite pulp, for example in the manufacture of cellulose ethers, cellulose acetates and microcrystalline cellulose.

Without being bound by theory, it is believed that the increase in aldehyde content relative to conventional kraft pulp provides additional active sites for etherification to end-products such as carboxymethylcellulose, methylcellulose, hydroxypropylcellulose, and the like, while simultaneously reducing the viscosity and DP without imparting significant yellowing or discoloration, enabling production of a fiber that can be used for both papermaking and cellulose derivatives.

In some embodiments, the modified kraft fiber has chemical properties that make it suitable for the manufacture of cellulose ethers. Thus, the disclosure provides a cellulose ether derived from a modified kraft fiber as described. In some embodiments, the cellulose ether is chosen from ethylcellulose, methylcellulose, hydroxypropyl cellulose, carboxymethyl cellulose, hydroxypropyl methylcellulose, and hydroxyethyl methyl cellulose. It is believed that the cellulose ethers of the disclosure may be used in any application where cellulose ethers are traditionally used. For example, and not by way of limitation, the cellulose ethers of the disclosure may be used in coatings, inks, binders, controlled release drug tablets, and films.

In some embodiments, the modified kraft fiber has chemical properties that make it suitable for the manufacture of cellulose esters. Thus, the disclosure provides a cellulose ester, such as a cellulose acetate, derived from modified kraft fibers of the disclosure. In some embodiments, the disclosure provides a product comprising a cellulose acetate derived from the modified kraft fiber of the disclosure. For example, and not by way of limitation, the cellulose esters of the disclosure may be used in, home furnishings, cigarette filters, inks, absorbent products, medical devices, and plastics including, for example, LCD and plasma screens and windshields.

In some embodiments, the modified kraft fiber of the disclosure may be suitable for the manufacture of viscose. More particularly, the modified kraft fiber of the disclosure may be used as a partial substitute for expensive cellulose starting material. The modified kraft fiber of the disclosure may replace as much as 25% or more, for example as much as 20%, for example as much as 15%, for example as much as 10% of the expensive cellulose starting materials. Thus, the disclosure provides a viscose fiber derived in whole or in part from a modified kraft fiber as described. In some embodiments, the viscose is produced from modified kraft fiber of the present disclosure that is treated with alkali and carbon disulfide to make a solution called viscose, which is then spun into dilute sulfuric acid and sodium sulfate to reconvert the viscose into cellulose. It is believed that the viscose fiber of the disclosure may be used in any application where viscose fiber is traditionally used. For example, and not by way of limitation, the viscose of the disclosure may be used in rayon, cellophane, filament, food casings, and tire cord.

In some embodiments, the kraft fiber is suitable for the manufacture of microcrystalline cellulose. Microcrystalline cellulose production requires relatively clean, highly purified starting cellulosic material. As such, traditionally, expensive sulfite pulps have been predominantly used for its production. The present disclosure provides microcrystalline cellulose derived from kraft fiber of the disclosure. Thus, the disclosure provides a cost-effective cellulose source for microcrystalline cellulose production.

The cellulose of the disclosure may be used in any application that microcrystalline cellulose has traditionally been used. For example, and not by way of limitation, the cellulose of the disclosure may be used in pharmaceutical or nutraceutical applications, food applications, cosmetic applications, paper applications, or as a structural composite. For instance, the cellulose of the disclosure may be a binder, diluent, disintegrant, lubricant, tabletting aid, stabilizer, texturizing agent, fat replacer, bulking agent, anticaking agent, foaming agent, emulsifier, thickener, separating agent, gelling agent, carrier material, opacifier, or viscosity modifier. In some embodiments, the microcrystalline cellulose is a colloid.

Other products comprising cellulose derivatives and microcrystalline cellulose derived from kraft fibers according to the disclosure may also be envisaged by persons of ordinary skill in the art. Such products may be found, for example, in cosmetic and industrial applications.

As used herein, "about" is meant to account for variations due to experimental error. All measurements are understood to be modified by the word "about", whether or not "about" is explicitly recited, unless specifically stated otherwise. Thus, for example, the statement "a fiber having a length of 2 mm" is understood to mean "a fiber having a length of about 2 mm."

The details of one or more nonlimiting embodiments of the invention are set forth in the examples below. Other embodiments of the invention should be apparent to those of ordinary skill in the art after consideration of the present disclosure.

EXAMPLES

Test Protocols

1. Caustic solubility (R10, S10, R18, S18) is measured according to TAPPI T235-cm00.
2. Carboxyl content is measured according to TAPPI T237-cm98.
3 Aldehyde content is measured according to Econotech Services LTD, proprietary procedure ESM 055B.
4. Copper Number is measured according to TAPPI T430-cm99.
5. Carbonyl content is calculated from Copper Number according to the formula: carbonyl=(Cu. No.−0.07)/0.6, from *Biomacromolecules* 2002, 3, 969-975.
6. 0.5% Capillary CED Viscosity is measured according to TAPPI T230-om99.
7. Intrinsic Viscosity is measured according to ASTM D1795 (2007).
8. DP is calculated from 0.5% Capillary CED Viscosity according to the formula: DPw=−449.6+598.4 ln (0.5% Capillary CED) 118.02 $\ln^2$ (0.5% Capillary CED), from the 1994 Cellucon Conference published in *The Chemistry and Processing Of Wood And Plant Fibrous Materials*, p. 155, woodhead Publishing Ltd, Abington Hall, Abington, Cambridge CBI 6AH, England, J. F. Kennedy, et al. editors.
9. Carbohydrates are measured according to TAPPI T249-cm00 with analysis by Dionex ion chromatography.
10. Cellulose content is calculated from carbohydrate composition according to the formula: Cellulose=Glucan−(Mannan/3), from *TAPPI Journal* 65(12):78-80 1982,
11 Hemicellulose content is calculated from the sum of sugars minus the cellulose content.
12. Fiber length and coarseness is determined on a Fiber Quality Analyzer™ from OPTEST, Hawkesbury, Ontario, according to the manufacturer's standard procedures.
13. Brightness is determined according to TAPPI T525-om02.

Example 1

Methods of Preparing Fibers of the Disclosure

Fiber was obtained after the first stage of a five stage commercial bleaching process.

The fiber was then subjected to the remaining four stages of bleaching; however, the second and fourth stages (originally alkaline stages E1 and E2) of the bleaching sequence were acidic catalytic oxidation stages.

The conditions of each bleaching stage and the fiber characteristics are set forth in Table 1 below.

TABLE 1

| Ex. No. | Stage | Time min | Temp. ° C. | Chemicals H2O2 (%) | ClO2 (%) | NaOH (%) | Fe + 2 (ppm) | pH initial | pH final | Resid. % on pulp | Visc. cps | R18 % | Brightness ISO | Kappa |
|---|---|---|---|---|---|---|---|---|---|---|---|---|---|---|
| 1 | D0 | | | | | | | | | | 7.12 | n/a | n/a | 1.37 |
| | Oxid | 90 | 80 | 1.5 | n/a | n/a | 150 | 3.68 | 3.07 | 0.012 | 3.29 | n/a | n/a | n/a |
| | D1 | 150 | 80 | n/a | 0.8 | n/a | n/a | 9.52 | 2.4 | 0.049 | 3.43 | n/a | 88 | n/a |
| | Oxid | 90 | 80 | 1.5 | n/a | 1.68 | 150 | 3.57 | 2.68 | 0.012 | 2.44 | n/a | n/a | n/a |
| | D2 | 150 | 80 | n/a | 0.2 | n/a | n/a | 6.14 | 3.01 | 0.01 | 2.46 | n/a | 86.1 | n/a |

Examples 2-4

Fiber was again obtained after the first stage of a five stage commercial bleaching process.

The fiber was then subjected to the remaining four stages of bleaching; however, the second and fourth stages (originally alkaline stages E1 and E2) of the bleaching sequence were again substituted by acidic catalytic oxidation stages. The conditions of the stages were varied and the effects on the fiber were noted.

The conditions of each bleaching stage are set forth in Table 2 below and the fiber properties are set forth in Table 3.

TABLE 2

| Ex. No. | Stage | Time min | Temp. ° C. | Chemicals H2O2 (%) | ClO2 (%) | NaOH (%) | Fe + 2 (ppm) | pH final | Residual % on pulp | Visc. cps | Brightness ISO |
|---|---|---|---|---|---|---|---|---|---|---|---|
| 2 | D0 | | | | | | | | | | |
| | Oxid | 90 | 80 | 1.0 | n/a | n/a | 150 | 3.02 | 0.0 | | |
| | D1 | 240 | 80 | n/a | 0.8 | n/a | n/a | 2.48 | 0.05 | 4.09 | 84.7 |
| | Oxid | 90 | 80 | 1.0 | n/a | yes | 150 | 2.87 | 0.00 | | |
| | D2 | 240 | 80 | n/a | 0.2 | n/a | n/a | 3.44 | 0.00 | 2.61 | 87.8 |
| 3 | D0 | | | | | | | | | | |
| | Oxid | 90 | 80 | 1.5 | n/a | n/a | 150 | 2.93 | 0.18 | | |
| | D1 | 240 | 80 | n/a | 0.8 | n/a | n/a | 2.44 | 0.05 | 3.87 | 86.2 |
| | Oxid | 75 | 80 | 1.5 | n/a | 1.68 | 150 | 2.65 | 0.0 | | |
| | D2 | 240 | 80 | n/a | 0.2 | n/a | n/a | 3.48 | 0.0 | 2.41 | 88.1 |
| 4 | D0 | | | | | | | | | | |
| | Oxid | 75 | 80 | 2.0 | n/a | n/a | 150 | 2.87 | 0.35 | | |
| | D1 | 240 | 80 | n/a | 0.8 | n/a | n/a | 2.49 | 0.03 | 3.32 | 87.6 |
| | Oxid | 75 | 80 | 2.0 | n/a | n/a | 150 | 2.52 | Trace | | |
| | D2 | 240 | 80 | n/a | 0.2 | n/a | n/a | 3.45 | 0.0 | 2.44 | 88.7 |
| 5 | D0 | | | | | | | | | | |
| | Oxid | 75 | 80 | 1.0 | n/a | n/a | 100 | 3.29 | 0.0 | | |
| | D1 | 240 | 80 | n/a | 0.55 | n/a | n/a | 2.31 | 0.0 | | |
| | Oxid | 75 | 80 | 1.0 | n/a | 1.68 | 100 | 2.7 | 0.0 | | |
| | D2 | 240 | 80 | n/a | 0.15 | n/a | n/a | | 0.0 | 2.5 | 87.5 |
| 6 | D0 | | | | 0.8 | | | | | | |
| | Oxid | 90 | 70 | | n/a | 0.75% | 200 | 2.8 | 0.09% | | |
| | D1 | 240 | 80 | n/a | 0.8 | n/a | n/a | | | 15.3 | |
| | Oxid | 90 | 70 | 3.0 | n/a | 1.68 | 200 | 2.8 | 0.09% | | |
| | D2 | | | | | | | | | | |

TABLE 3

| Example No. | Carboxyl meq/100 grams | Aldehyde meq/100 grams | Copper No. | Carbonyl meq/100 grams |
|---|---|---|---|---|
| 2 | 5.03 | 6.97 | 5.48 | 9.02 |
| 3 | 6.48 | 6.82 | 5.95 | 9.80 |
| 4 | 6.70 | 7.80 | 5.70 | 9.38 |
| 5 | 5.38 | 6.69 | 5.89 | 9.70 |
| 6 | 4.66 | 6.74 | 5.10 | 8.45 |

As can be seen from Table 3, when the fiber is oxidized in more than one stage, the overall carbonyl content goes up. Moreover, both the carboxy functionality and aldehydic functionality are improved. A number of embodiments have been described. Nevertheless, it will be understood that various modifications may be made without departing from the spirit and scope of the disclosure. Accordingly, other embodiments are within the scope of the following claims.

We claim:

1. A method for making a kraft pulp comprising:

digesting and oxygen delignifying a cellulose kraft pulp; and bleaching the cellulose kraft pulp using a multi-stage bleaching process;

wherein the multi-stage bleaching process is a five-stage bleaching process comprising five total stages in sequential order, having a first stage, followed by a second stage, followed by a third stage, followed by a fourth stage, followed by a fifth stage;

wherein the cellulose kraft pulp is oxidized in the second stage of the bleaching process with the addition of a peroxide and a catalyst under acidic conditions;

wherein the cellulose kraft pulp is oxidized in the fourth stage of the bleaching process with the addition of a peroxide and a catalyst under acidic conditions; and wherein the peroxide in one of the second stage or the fourth stage is added in an amount ranging from about 0.1% to about 0.5% based on the dry weight of the kraft pulp and the peroxide in the other of the second stage or the fourth stage is added in an amount ranging from about 1.0% to about 2.0% based on the dry weight of the kraft pulp.

2. The method of claim 1, wherein the cellulose kraft pulp is southern pine fiber.

3. The method of claim 1, wherein the catalyst is chosen from at least one of copper and iron, the peroxide is hydrogen peroxide, and the pH of the second and fourth stages ranges from about 2 to about 6.

4. The method of claim 3, wherein the hydrogen peroxide added in the second stage is in an amount ranging from about 0.1% to about 0.5% based on the dry weight of the kraft pulp and the hydrogen peroxide added in the fourth stage is in an amount ranging from about 1.0% to about 2.0% based on the dry weight of the kraft pulp.

5. The method of claim 3, wherein the hydrogen peroxide added in the second stage is in an amount ranging from about 1.0% to about 2.0% based on the dry weight of the kraft pulp and the hydrogen peroxide added in the fourth stage is in an amount ranging from about 0.1% to about 0.5% based on the dry weight of the kraft pulp.

6. The method of claim 4, wherein an iron catalyst is added in each of the second and fourth stages in an amount ranging from about 25 to about 200 ppm.

7. The method of claim 6, wherein the iron catalyst is added in the second stage in an amount ranging from about 50 to about 100 ppm.

8. The method of claim 7, wherein the iron catalyst is added in the fourth stage in an amount ranging from about 100 to about 200 ppm.

9. The method of claim 5, wherein an iron catalyst is added in each of the second and fourth stages in an amount ranging from about 25 to about 200 ppm.

10. The method of claim 9, wherein the iron catalyst is added in the second stage in an amount ranging from about 100 to about 200 ppm.

11. The method of claim 10, wherein the iron catalyst is added in the fourth stage in an amount ranging from about 50 to about 100 ppm.

* * * * *